US006480216B2

(12) United States Patent
Ando

(10) Patent No.: US 6,480,216 B2
(45) Date of Patent: Nov. 12, 2002

(54) PRINT HEAD PRESSURE MECHANISM, AND A PRINTER USING THE SAME

(75) Inventor: Mitsuhisa Ando, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/749,374

(22) Filed: Dec. 22, 2000

(65) Prior Publication Data

US 2001/0015749 A1 Aug. 23, 2001

(30) Foreign Application Priority Data

Jan. 26, 2000 (JP) ..... 12-017612

(51) Int. Cl.[7] ..... B41J 25/316; B41J 25/304
(52) U.S. Cl. ..... 347/197; 400/120.16
(58) Field of Search ..... 347/197; 400/120.16

(56) References Cited

U.S. PATENT DOCUMENTS

| | | | | |
|---|---|---|---|---|
| 4,750,880 A | | 6/1988 | Stephenson et al. | |
| 5,697,714 A | * | 12/1997 | Onuki et al. | 347/197 |
| 5,746,520 A | * | 5/1998 | Kohira | 347/197 |

FOREIGN PATENT DOCUMENTS

| | | |
|---|---|---|
| JP | 62-011670 | 1/1987 |
| JP | 10-119327 | 5/1989 |
| JP | 02-113955 | 4/1990 |
| JP | 06-143736 | 5/1994 |
| JP | 09-216436 | 8/1997 |
| JP | 09-248923 | 9/1997 |
| JP | 09-277647 | 10/1997 |
| JP | 10-100507 | 4/1998 |
| JP | 10-129075 | 5/1998 |
| JP | 2914382 | 4/1999 |

* cited by examiner

*Primary Examiner*—Huan Tran
(74) *Attorney, Agent, or Firm*—Hogan & Hartson, LLP

(57) ABSTRACT

A print head pressure mechanism is disclosed that maintains uniform pressure between the thermal print head and platen roller regardless of variations in parts precision, and thus prints with uniform print density. The print head pressure mechanism has first and second support shafts disposed at both sides in the direction of a heat element line L1 of the thermal print head, a frame member for supporting the print head, and having first and second contact parts for contacting the first and second support shafts, and an one or more urging unit for pushing the print head to the platen with the urging means operating on the side of the print head opposite the side to which the heat elements are disposed. When the platen is separated from the print head, the platen axis and heat element line L1 of the print head are not parallel to each other. When the platen is in contact with the print head heat elements, and the first support shaft is in contact with the first contact part, the platen axis is substantially parallel to the heat element line L1 of the print head heat elements.

20 Claims, 8 Drawing Sheets

PRINT HEAD PRESSURE MECHANISM, AND A PRINTER USING THE SAME

BACKGROUND OF THE INVENTION

1. Field of the Invention

The present invention relates to a printer that uses a thermal printing technique, and relates more particularly to a thermal printer having a print head pressure mechanism for pressing a thermal print head against a platen roller.

2. Description of the Related Art

A print head pressure mechanism 100 according to the related art is shown in FIGS. 8(*a*) and 8(*b*). This print head pressure mechanism 100 has a thermal print head 101, platen roller 102, and compression springs 109, comprised such that the compression springs 109 push the thermal print head 101 against the platen roller 102 for printing.

The heat elements of the thermal print head 101 are disposed on a ceramic substrate having a driver IC mounted thereon. The ceramic substrate is supported on a head support base 103, which functions as a heat radiator. The head support base 103 is basically rectangular with support shafts 104, 105 disposed coaxially to each other in the longitudinal direction of the head support base 103. The thermal print head 101 is supported by these support shafts 104, 105 so that it can pivot relative to the printer body 106.

An axle 108 passes longitudinally through platen roller 102. The axle 108 is rotationally supported by printer body 106 with the axle 108 parallel to the longitudinal axis of the support shafts 104, 105 of head support base 103.

A plurality of compression springs 109 push against the back (that is, the side opposite the side supporting the ceramic substrate) of thermal print head 101, urging the thermal print head 101 in the direction of the platen roller so that pressure will be evenly applied along the contact line between thermal print head 101 and platen roller 102.

SUMMARY OF THE INVENTION

A problem with a print head pressure mechanism 100 according to the related art as described above is that the relationship between the longitudinal axis of the head support base 103 and the longitudinal axis of the platen roller 102 deviates from the expected parallel relationship due, for example, to variations in the manufacturing precision of various parts. This means that the pressure between the thermal print head 101 and platen roller 102 is not actually uniform. A uniform print density can therefore not be achieved.

It is an object of the present invention to overcome the aforementioned problem of the prior art, and to provide a thermal printer having a print head pressure mechanism that can maintain uniform pressure between the thermal print head and the platen roller without being affected by variations in component precision, and which can therefore print with uniform print density.

To achieve this and other objects, a print head pressure mechanism according to the present invention has a platen roller with a platen shaft extending longitudinally therethrough so that the platen rotates around the platen shaft; a print head support having a thermal print head of a length able to print using a thermal printing method to a recording medium held between the print head support and the platen roller, and a support shaft parallel to the thermal print head, the print head support being movable along a specific path pivoting on the support shaft at one end; and a pressure member disposed at a particular position on the side opposite the thermal print head side of the print head support.

Because one end of the print head support is held fixed at one end of the support shaft while the other end of the support shaft is moved to alignment with the platen roller, the thermal print head of the print head support can contact the platen roller uniformly regardless of the positioning precision of the platen roller.

If the pressure member is positioned so that pressure is applied evenly to the contact parts of the platen roller and the thermal print head of the print head support, the thermal print head can be held uniformly against the recording medium. Printing with uniform print density is therefore possible regardless of variations in parts precision.

Further, the print head pressure mechanism includes a positioning member for positioning the one end of the support shaft of the print head support, and a guide member for guiding along a specific path the other end of the support shaft of the print head support. The print head support is reliably guided through a specific path to the platen roller.

Further, the pressure member is disposed with a pressure working point on a line offset by a distance to the support shaft side of the print head support from the contact line between the thermal print head and platen roller, and distributed equally with respect to a specific reference point on said line. This configuration assures that uniform pressure is applied to the contact line between the thermal print head and platen roller.

Further, the pressure member is disposed offset by a distance from the position determined relative to the specific reference point.

The shift in the working point of the load from the pressure member during actual printing can be obtained by computer analysis using various external factors contributing to the shift. By offsetting the positions of the pressure members the distance determined by this computer analysis from the position of static balance, which is achieved by positioning the pressure member as described above according to the present invention, a so-called dynamic balance can be achieved during printing.

A printer according to the present invention has a printer body capable of holding a recording medium; and a positioning support member for disposing a print head pressure mechanism according to the present invention inside the printer body for printing to the recording medium, the positioning support member being disposed to the platen roller drive side of the printer body.

Preferably in this case, the printer has a printer cover that opens and closes to the printer body. The platen roller of the print head pressure mechanism is disposed on the printer cover so that the platen roller approaches and separates from the thermal print head in conjunction with printer cover opening and closing.

It is therefore possible for the present invention to provide a printer that can print to a recording medium with uniform print density regardless of variations in parts precision.

Other objects and attainments together with a fuller understanding of the invention will become apparent and appreciated by referring to the following description and claims taken in conjunction with the accompanying drawings.

DETAILED DESCRIPTION OF THE PREFERRED EMBODIMENTS

The preferred embodiments of a printer comprising a print head pressure mechanism according to the present invention are described below with reference to the accompanying figures.

First Embodiment

Figure 1:
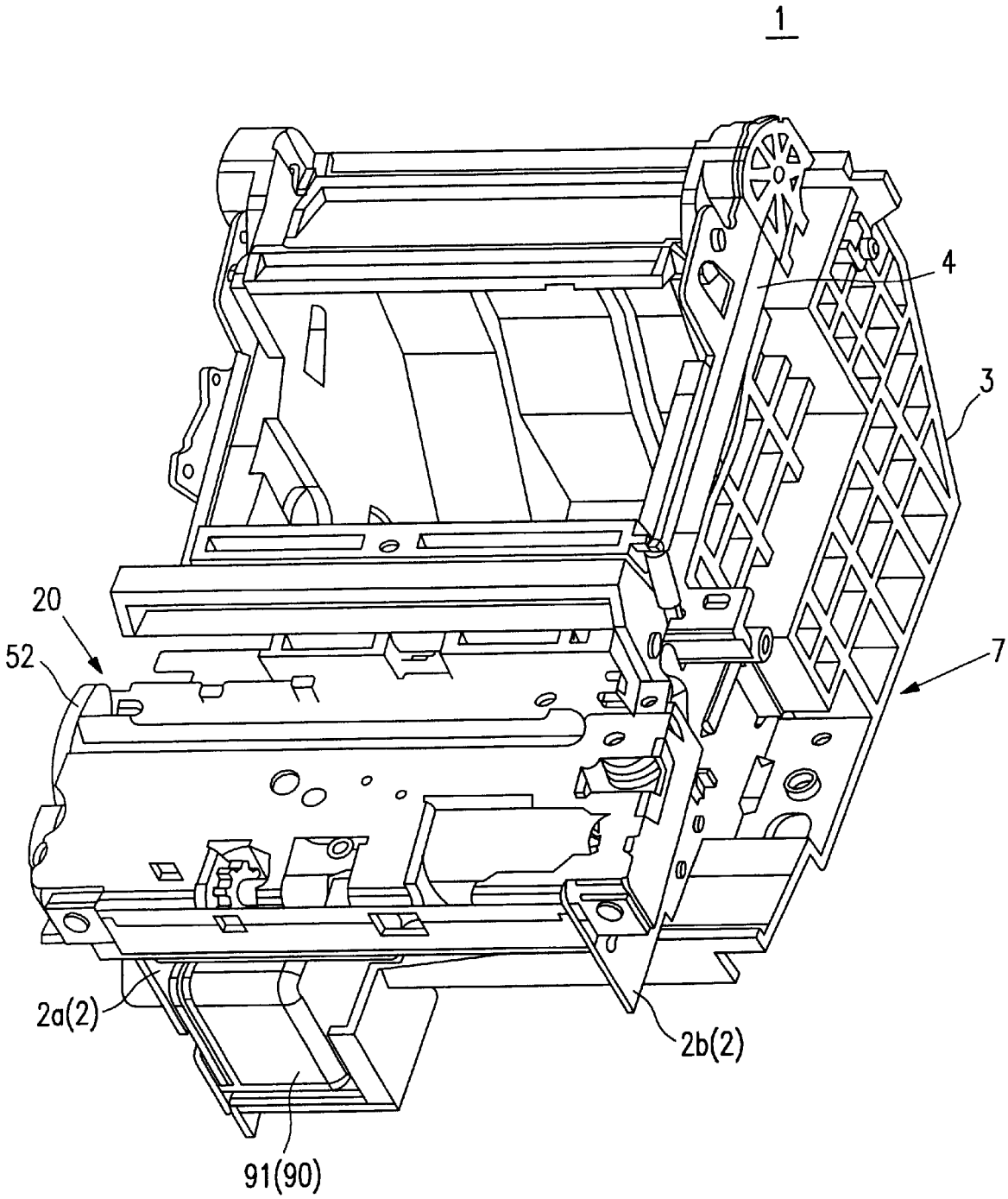
FIG. 1 is an perspective view of a printer according to an embodiment of the present invention.

FIG. 1 is a perspective view of the basic internal configuration of a printer according to an embodiment of the present invention. The printer 1 has a pair of frame members 2 (2*a*, 2*b*), which are basically rectangular in shape, typically made from metal, and disposed substantially parallel to each other. A drive unit 90 which drives a platen roller 50 (described in further detail below) is disposed on one side of the printer, referred to as "the drive side", while the other side of the printer is referred to as the "non-drive side". The frame member 2*a* is disposed on the drive side of the printer and is referred to as the drive side frame member, while the frame member 2*b* is disposed on the non-drive side and is referred to as the non-drive side frame member.

A roll paper holder 3 is provided at the back of the frame members 2. The roll paper holder 3 is typically molded from resin, for example, to form a box-like shape suitable for holding a roll of paper.

The frame members 2 and roll paper holder 3 together form printer case 7 that constitute the framework of printer 1.

A cover 4 is disposed at the back end of roll paper holder 3 so that it can open and close to frame members 2 and roll paper holder 3. The cover 4 is large enough to cover part of frame members 2 and roll paper holder 3.

Figure 4:
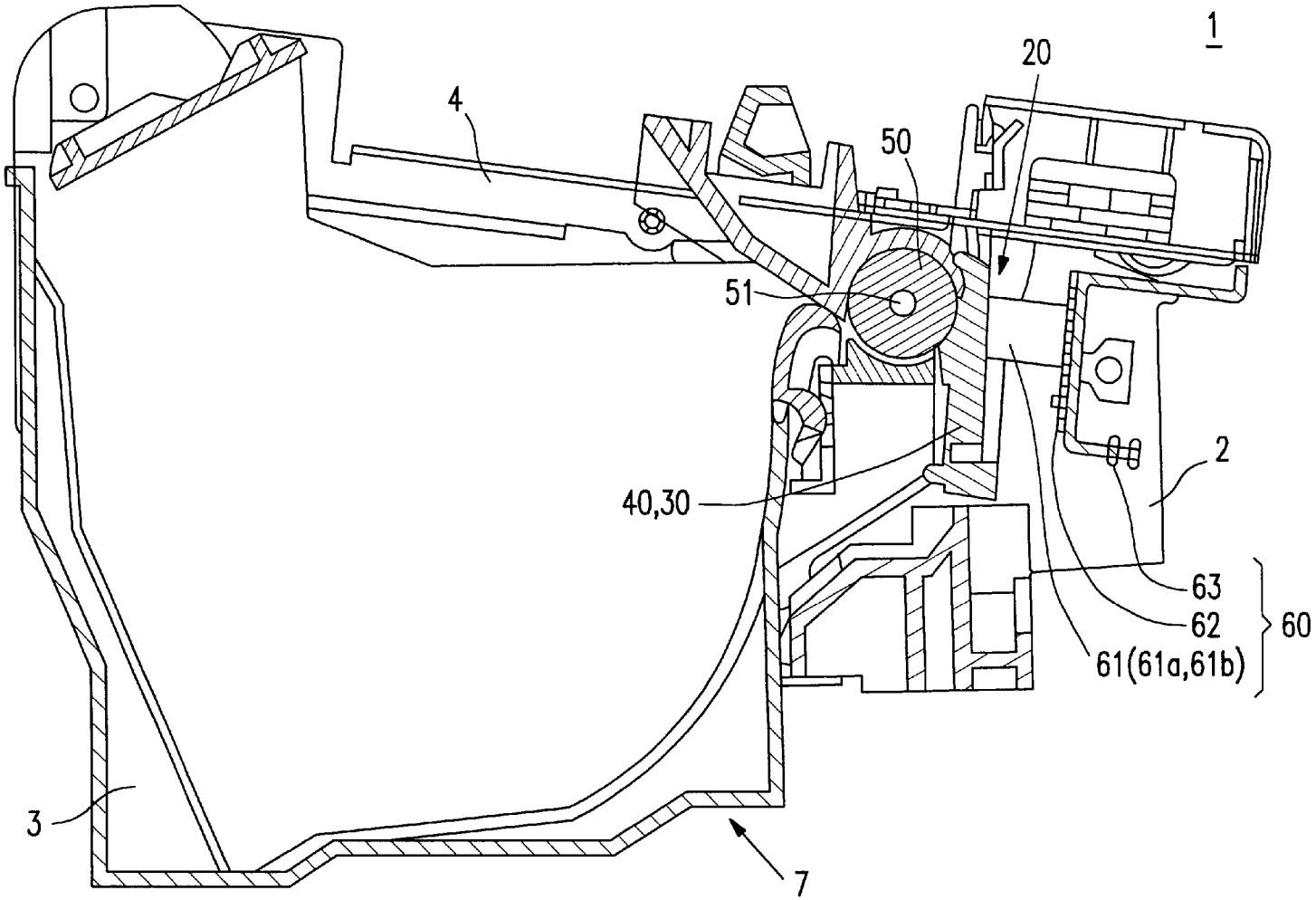
FIG. 4 is a section view from the drive side of the printer shown in FIG. 1.

FIG. 4 is a section view of the printer from the side of drive-side frame member 2*a*. The printer 1 has a print head pressure mechanism 20, which consists of print head support 30 to which a thermal print head 40 is disposed, platen roller 50, and urging unit (such as a spring unit) 60.

Figure 6A:
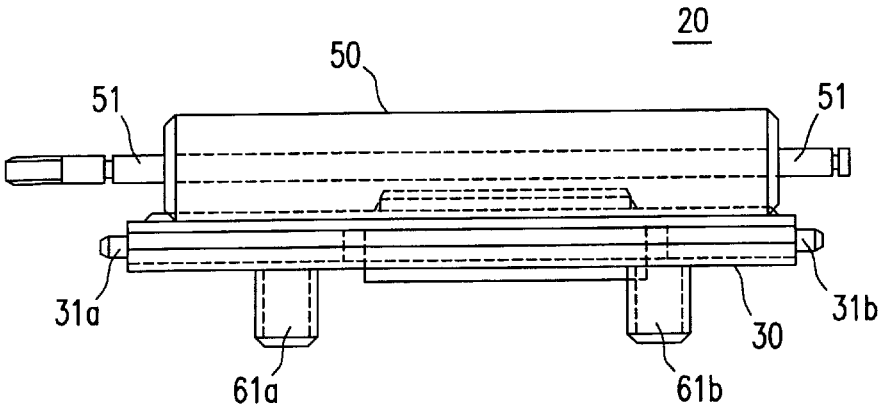
FIG. 6(*a*) is a view of the print head pressure mechanism shown in FIG. 5(*a*) in the direction of arrow A in FIG. 5(*a*), and FIG. 6(*b*) is a view in the direction of arrow B in FIG. 5(*a*)
Figure 6B:
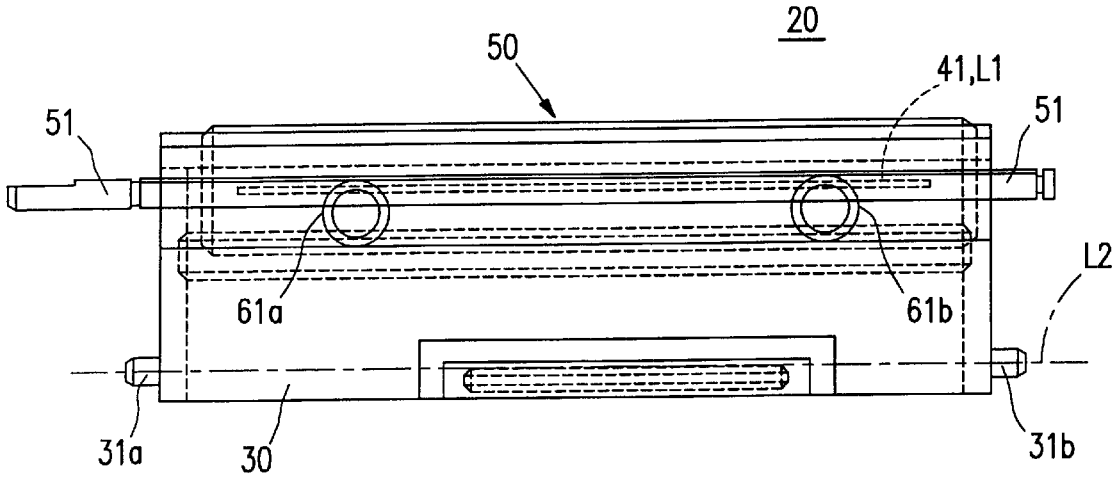
Figures 2, 7A:
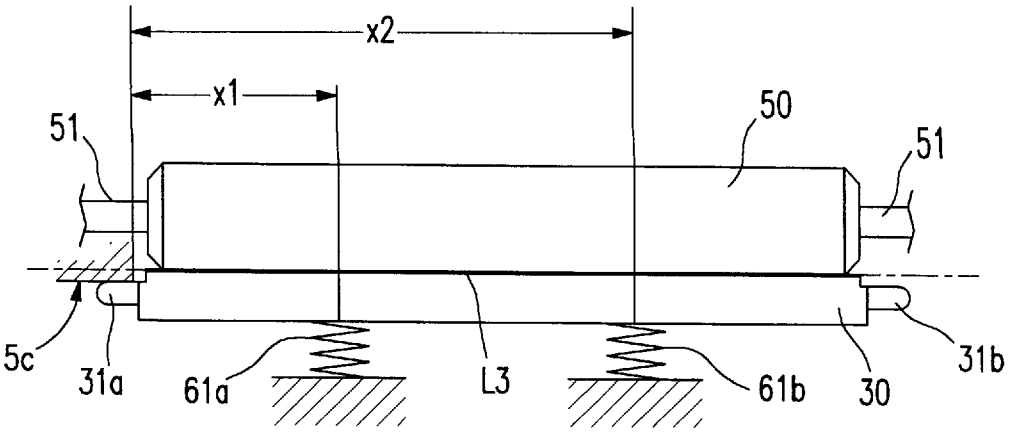
Figure 7C:
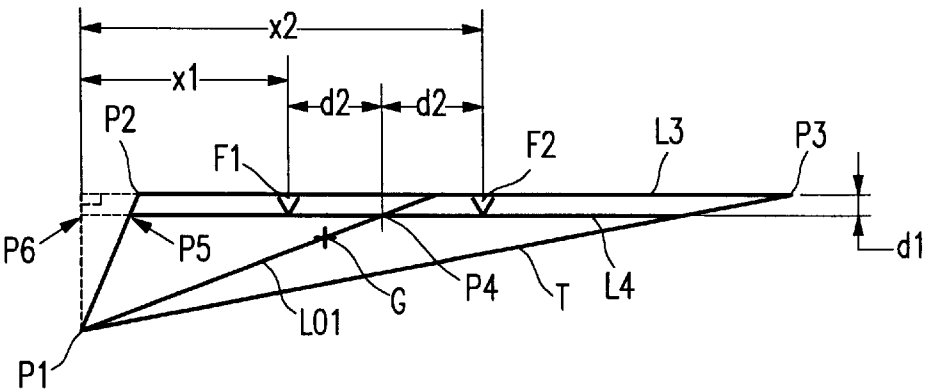
FIG. 7(*a*)-1 is a side view from the drive side, and FIG. 7(*a*)-2 is a top view, of print head pressure mechanism shown in FIGS. 5(*a*) and 5(*b*), FIG. 7(*b*) is a side view from the drive side of the print head pressure mechanism shown in FIGS. 5(*a*) and 5(*b*), and FIG. 7(*c*) schematically illustrates the determination of the point of compression spring action in the print head pressure mechanism.
Figures 1, 7A:
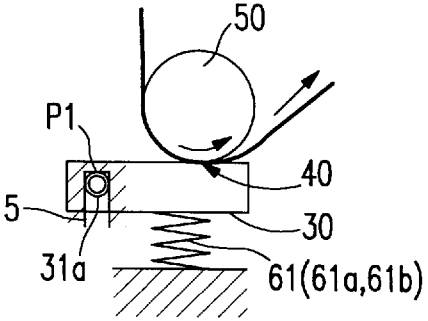
Figure 7B:
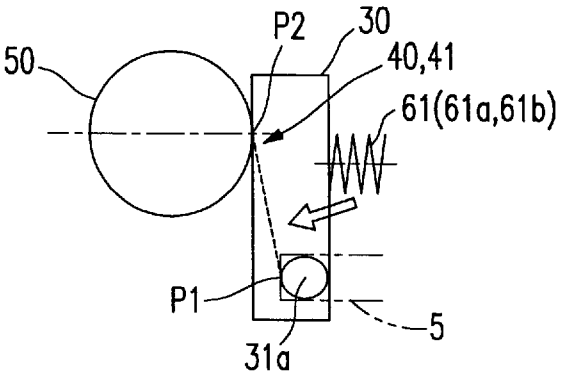
Figure 8B:
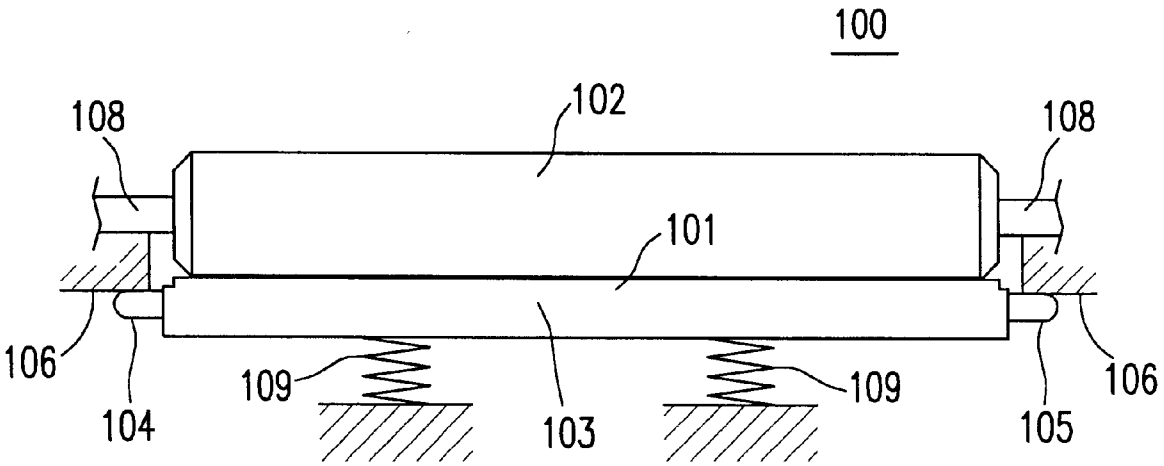
FIG. 8(b) Prior Art
FIGS. 8(*a*) and 8(*b*) show a print head pressure mechanism according to the related art.
Figure 8A:
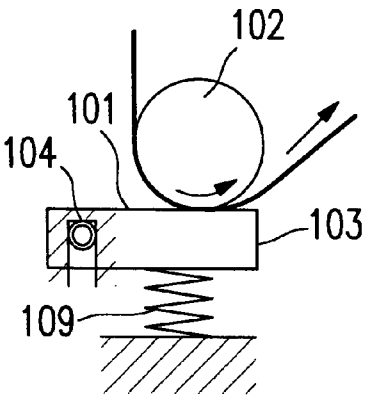
FIG. 8(a) Prior Art

FIGS. 6(*a*) and 6(*b*) show the main parts of the print head pressure mechanism 20, FIG. 6(*a*) being a top view and FIG. 6(*b*) being a front view. The print head support 30 is a thin, substantially rectangular body made from aluminum or other suitable material.

A head surface 41 having a plurality of heat elements disposed thereon in a line is formed on one end of the print head support 30. This line of heat elements is referred to below as heat element line L1. Support shafts 31*a* and 31*b* are disposed on another end of print head support 30 with the line through the support shafts 31*a* and 31*b* parallel to heat element line L1. The line through the support shafts is referred to below as support shaft line L2. The thermal print head 40 is thus pivotally supported to frame members 2 by way of intervening support shafts 31*a* and 31*b*.

Figure 5A:
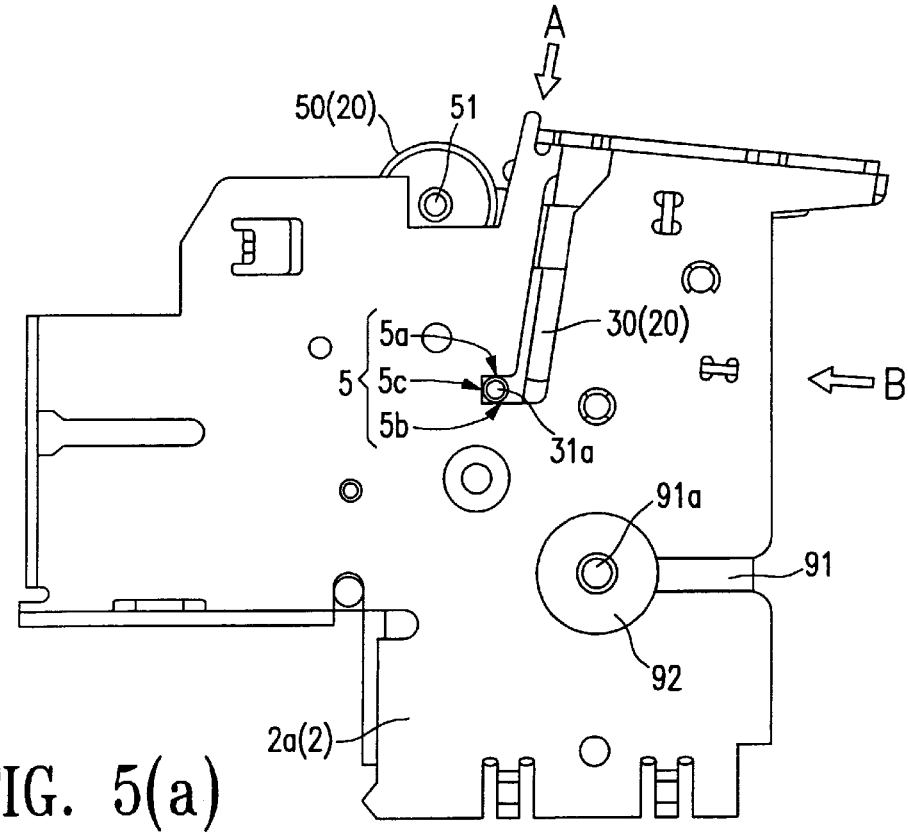
FIG. 5(*a*) is a side view from the drive side of the print head pressure mechanism in the printer shown in FIG. 1, and FIG. 5(*b*) is a side view from the non-drive side of the print head pressure mechanism in the printer shown in FIG. 1.
Figure 5B:
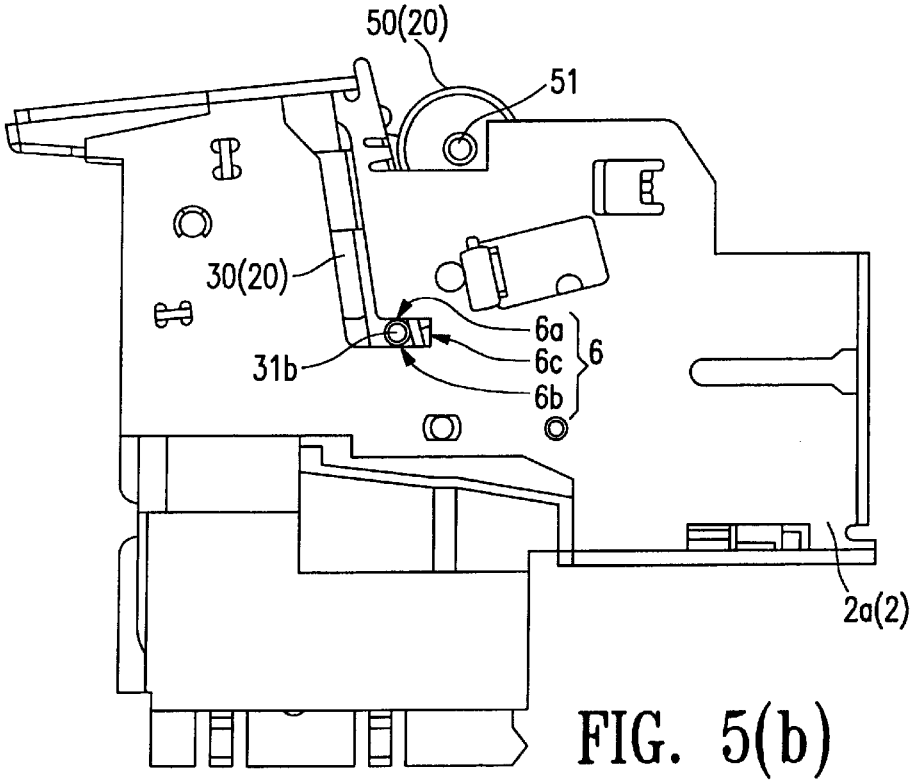

FIGS. 5(*a*) and 5(*b*) are side views of the frame members 2. FIG. 5(*a*) shows the frame members 2 from the drive-side frame member 2*a* side, and FIG. 5(*b*) from the frame member 2*b* on the non-drive side. A positioning channel 5 (positioning member) for supporting support shaft 31*a* of the print head support 30 is defined in drive-side frame member 2*a*, and a guide channel 6 (guide member) is defined the non-drive side frame member 2*b*.

As shown in FIG. 5(*a*), the positioning channel 5 is the substantially horizontal part (extending in a direction substantially perpendicular to the axis of the platen shaft 51, which is further described below) of the substantially L-shaped channel formed from the top to about the middle of drive-side frame member 2*a*. The positioning channel 5 is slightly wider than the outside diameter of support shaft 31*a* of print head support 30, and consists of guide edges 5*a* and 5*b* for guiding support shaft 31 a therebetween to the back, and an end portion (an end edge) 5*c* for contacting and stopping further movement of the support shaft 31*a* beyond the inside end of the guide edges 5*a* and 5*b*. The end edge 5*c* determines the relative positions of the thermal print head 40 and platen roller 50, in the direction the former is pressed against the latter, at one end in the axial direction of the platen roller.

As shown in FIG. 5(*b*), the guide channel 6 is formed in the non-drive side frame member 2*b* substantially symmetrically to positioning channel 5. The guide channel 6 thus has guide edges 6*a* and 6*b* formed identically to the guide edges 5*a* and 5*b* of positioning channel 5, and an end portion (an end edge) 6*c* that is formed farther back than end edge 5*c* of positioning channel 5. That is, when viewed in a direction parallel to the platen axis, the end edges 5*c* and 6*c* do not overlap each other. Rather, the end edge 6*c* extends further toward the platen roller side.

The thermal print head 40 is thus supported on frame members 2 by fitting the support shafts 31*a* and 31*b* of print head support 30 into the positioning channel 5 and guide channel 6 of the frame members 2.

The print head support 30 is circularly movable about support shaft line L2 by way of support shafts 31*a* and 31*b*, and the support shafts 31*a* and 31*b* can move inside positioning channel 5 and guide channel 6.

As shown in FIG. 4, platen roller 50 of print head pressure mechanism 20 is rotatably mounted on the front end of cover 4 by means of the platen shaft 51. The platen shaft 51 is disposed parallel to a line that is perpendicular to the frame members 2 and is kept substantially parallel to that line when the cover is moved between its open and closed positions. When the cover 4 is closed, platen roller 50 contacts the head surface 41 of thermal print head 40 in conjunction with movement of the print head support 30.

The urging unit (spring unit) 60 of print head pressure mechanism 20 is disposed in front of the positioning channel 5 and guide channel 6 in frame members 2, and comprises an urging member such as a compression spring 61, spring support 62, and spring mount 63.

The compression spring 61 can use a specific number of spring elements each formed with the same compression force. Two spring elements are used in this preferred embodiment of the invention. The spring support 62 supports the compression spring 61 projecting therefrom at a specific location. The spring mount 63 is fastened to frame members 2 so that the spring support 62 is freely removable. The spring unit 60 is configured so that the seat of compression spring 61 contacts a specific position further described below at the back of print head support 30 (that is, the side thereof opposite head surface 41).

The position where compression spring 61 contacts print head support 30, that is, the working point of force from the compression spring, is further described below with reference to FIGS. 7(*a*)–(*c*). It should be noted that in FIGS. 7(*a*)–(*c*), capital letters are used to indicate lines, and lowercase letters are used in reference to the length of a line.

With reference to FIG. 7(*c*), the following elements are first defined as follows to obtain the position contacted by compression spring 61. The point of contact between support shaft 31*a* of print head support 30 and end edge 5*c* of positioning channel 5 in drive-side frame member 2*a* is reference point P1, and the line of contact between head surface 41 of thermal print head 40 and platen roller 50 is print line L3 (which substantially coincide with heat element line L1).

The scalene triangle of which the vertices are reference point P1, end point P2 of print line L3 on the same end thereof as reference point P1, and end point P3 at the other end of the print line L3, is defined as the working triangle T. Working line L4 is a line parallel to print line L3 offset distance d1 toward reference point P1. The intersection between working line L4 and the line L01 connecting the center of gravity G of working triangle T and reference point P1 (that is, the line (median) connecting reference point P1 and the center of the line segment L3) is reference point (or the working point) P4.

By putting the working point of the compression spring on line L01, support shaft 31*a* of thermal print head 40 will not separate from end edge 5*c* of positioning channel 5, and a load can be evenly applied to print line L3. In other words, the thermal print head can be pressed evenly against the platen roller.

Those of ordinary skill in the related art will recognize that that one or a plurality of compression springs can be used. If a plurality of springs is used, it is only necessary to position the springs so that the combined force of all springs acts on line L01. A plurality of springs is preferably used because in an actual printer product load variations occur easily when only one compression spring is used due to variations in the stiffness of the printing medium and reaction from the gears driving the platen roller.

Moreover, the working point of the springs is preferably disposed at a position on line L01 closer to print line L3 than to reference point P1. This is because if the working point is nearer to reference point P1, load variations resulting from, for example, variations in parts precision among various printers will be increased along the print line L3 because of the lever principle. Furthermore, the print head load, that is, the pressure of the print head pressed against the platen roller, is determined by the load and the position of the load working on line L01.

Two compression springs 61 (61*a*, 61*b*), each having the same compressive force, are used in the following description. The first compression spring 61*a* and the second compression spring 61*b* contact the thermal print head 40 at working points F1 and F2 on working line L4 inside working triangle T. More specifically, working point F1 of first compression spring 61*a* is between reference point P4 and intersection P5 of line P1P2 and working line L4. That is, the length x1 from foot of perpendicular P6 (which is the intersection of an extension of working line L4 and a line perpendicular to the line L4 and passing reference point P1) to working point F1 is greater than line segment P6P5 and shorter than line segment P6P4. This is because support shaft 31*a* of thermal print head 40 separates from end edge 5*c* of positioning channel 5 when the length x1 becomes longer than line segment P6P4.

The working point F2 of second compression spring 61*b* is set so that length x2 from foot of perpendicular P6 to working point F2 is equal to length x1 plus twice the distance d2 between working point F1 and reference point P4 (x2=x1+2*d2). This means that the combined force of the two compression springs 61*a* and 61*b* acts at reference point P4 of line L01.

Based on the above-described positions, the moment M around foot of perpendicular P6 can be calculated from the following equation where force f is the compressive load of the compression springs 61*a* and 61*b*.

$$M=f*x1+f*x2=2*f*(x1+d2)$$

From the right side 2*f*(x1+d2) in this equation, we know the moment M around foot of perpendicular P6 when the combined force of compression springs 61*a* and 61*b* (2*f) operates on reference point P4.

The compression springs 61*a* and 61*b* are thus disposed to produce a uniform load on working line L4 in working triangle T, and positioned to produce a uniform load along print line L3. In this case, because working line L4 is offset from print line L3 toward reference point P1, support shaft 31*a* on the drive side of print head support 30 will not separate from end edge 5*c* of positioning channel 5 in drive-side frame member 2*a* at reference point P1. Furthermore, offset d1 can be chosen as needed according to variations in parts precision, for example.

Figure 2:
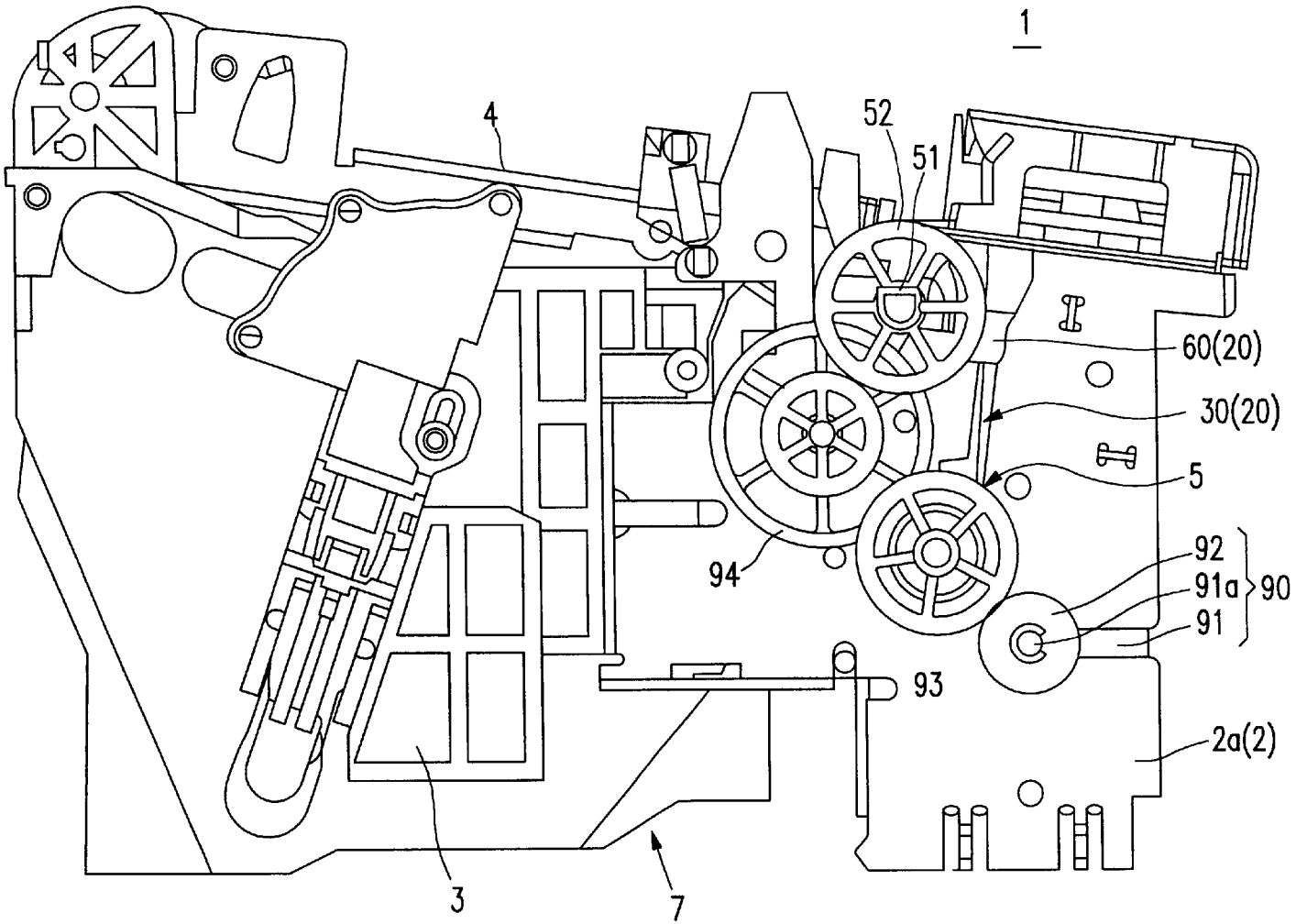
FIG. 2 is a side view from the drive side of the printer shown in FIG. 1.
Figure 3:
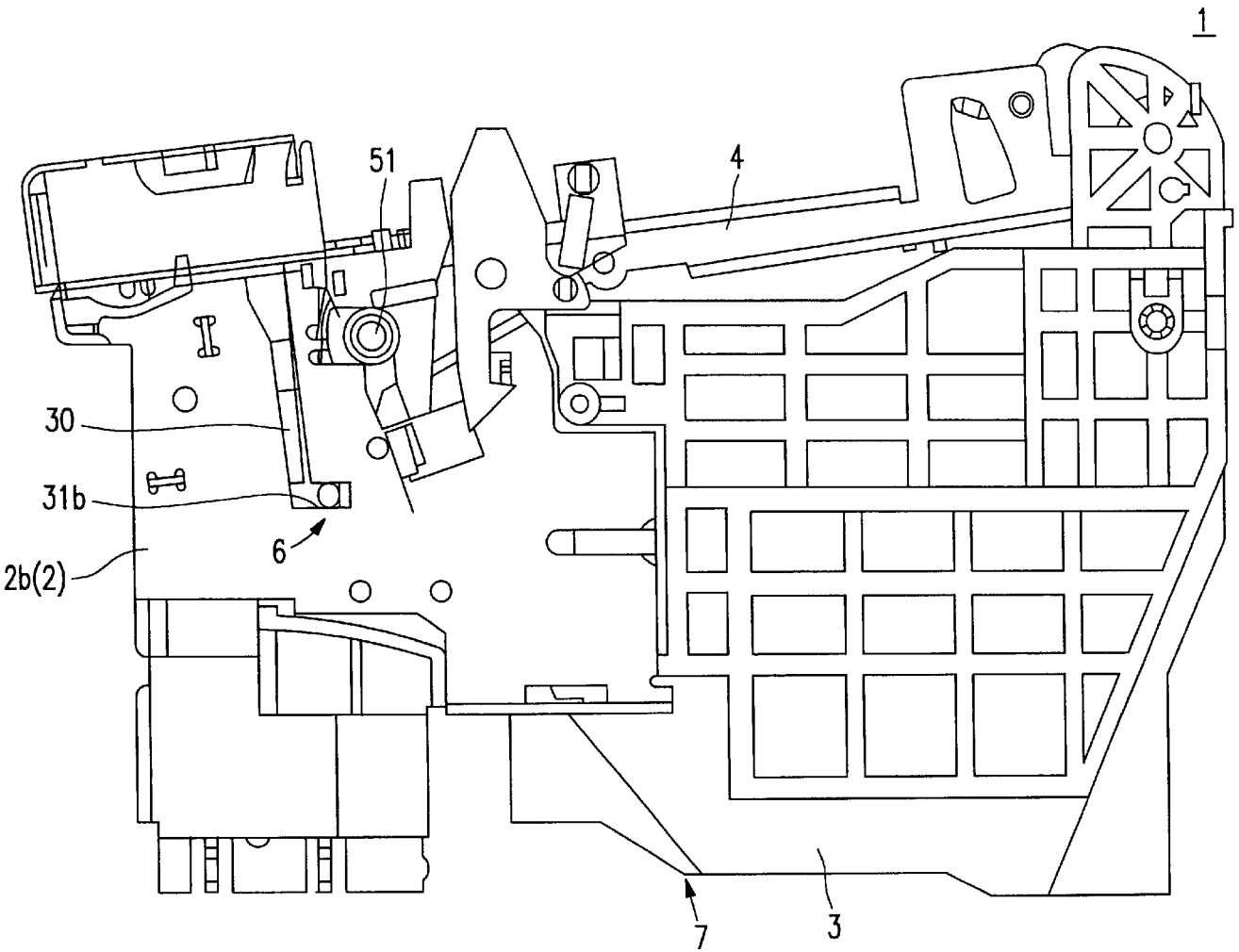
FIG. 3 is a side view from the non-drive side of the printer shown in FIG. 1.

As shown in FIG. 1 and FIG. 2, drive motor 91 of the drive unit 90 is disposed at the front bottom of drive-side frame member 2*a* with a drive gear 92 fixed to drive shaft 91*a* disposed on the outside of drive-side frame member 2*a*. A first intermediate gear 93 for engaging drive gear 92 of drive motor 91, and a second intermediate gear 94 meshing with the first intermediate gear 93, are further disposed to drive-side frame member 2*a*.

A platen gear 52 is fixed to the drive-side end of platen shaft 51 of platen roller 50. When the cover 4 is closed, this platen gear 52 meshes with second intermediate gear 94 so that power from drive motor 91 is transferred to turn the platen roller 50.

Thus, when cover 4 is open, the pressure from compression springs 61*a* and 61*b* on print head support 30 causes drive-side support shaft 31*a* to contact end edge 5*c* of positioning channel 5, and the other support shaft 31*b* to contact bottom edge 6*c* of guide channel 6. The other support shaft 31*b* on the non-drive side of print head support 30 is thus positioned more to the back of printer 1 than drive-side support shaft 31*a*. In this stage, the support shaft line L2 is not parallel to platen shaft 51. In other words, heating element line L1 intersects the projection of the axis of platen shaft 51 onto a reference plane defined by the heating element line L1 and the axis of platen shaft 51 when platen roller 50 contacts print head 40 (via a recording medium, if any).

When cover 4 is closed, platen roller 50 moves in the direction of thermal print head 40 of printer frame member 2 in conjunction with cover 4 movement, and platen roller 50 contacts a part of the head surface 41 near its non-drive side. Then, as platen roller 50 pushes the non-drive side part of print head support 30 forward, the contact with the head surface 41 gradually extends to the drive side. In this case, print head support 30 is held with drive-side support shaft 31*a* pressed by compression springs 61*a* and 61*b* to guide edge 5*a* of positioning channel 5 in drive-side frame member 2*a*, and the non-drive side support shaft 31*b* is separated from bottom edge 6*c* of guide channel 6 and moving along guide edges 6*a* and 6*b*. As head surface 41 slides across platen roller 50 in conjunction with this movement of print head support 30, heat element line L1 on the head surface 41 of thermal print head 40 approaches a position that is parallel to platen shaft 51 of platen roller 50. This means that the support line L2 is moveable in a plane which is substantially parallel to the reference plane defined above. When cover 4 is then completely closed and platen roller 50 movement stops, print head support 30 stops with the heat element line L1 of head surface 41 aligned with a surface of the platen roller 50. The thermal print head 40 thus evenly contacts the platen roller 50, forming print line L3 of the aforementioned working triangle T. In this state, lines L1 and L3 coincide, at least substantially (in practice, the print line L3 will not be a true line but have a finite width and, thus, an area in fact. Depending on the pressure and the material of the platen, the print head elastically flattens the contacted portion of the platen roller more or less so that the width of the print line is greater or smaller. The more the print head flattens the platen roller, the more the heating element line may be displaced from the perpendicular on the head surface that passes through the axis of the platen roller; in other words, the heating element line does not necessarily coincide with the center line of the contact area.

In other words, print head support 30 moves in a circularly fashion around support shaft line L2 in conjunction with the movement of platen roller 50, and the non-drive side support shaft 31*b* turns horizontally about reference point PI of drive-side support shaft 31*a*, until support shaft line L2 is positioned parallel to platen shaft 51.

The pressure along print line L3 is uniform because compression springs 61 are positioned with reference to working triangle T as described above. Paper or other recording medium held between thermal print head 40 and platen roller 50 is transported by the rotation of platen roller 50, and is printed on along print line L3. Good print quality can also be assured because the uniform pressure applied along print line L3 holds the recording medium in uniform contact with the heat elements of the thermal print head 40 positioned along the print line L3.

Because the support shaft 31*b* on the non-drive side is moved to align with platen roller 50 with drive-side support shaft 31*a* of print head support 30 fixed in position to platen roller 50, a print head pressure mechanism according to the present invention can hold the head surface 41 of thermal print head 40 on print head support 30 evenly in contact with platen roller 50 irrespective of the position of support shaft line L2 of print head support 30 relative to the frame members 2, and platen roller 50 to heat element line L1 of thermal print head 40. It is therefore also possible to print to the recording medium with uniform print density regardless of any variation in parts precision.

Furthermore, using two compression springs 61 as in the preferred embodiment of our invention described above has the advantage of being able to easily restore uniform pressure along print line L3 if a change in the load along print line L3 occurs when, for example, the paper is inserted between platen roller 50 and thermal print head 40.

Moreover, because positioning channel 5 is on the same side as the platen roller 50 drive unit 90, the positioning channel 5 and second intermediate gear 94 that meshes with platen gear 52 can be easily positioned relative to each other with good precision in the same drive-side frame member 2*a*. As a result, reference point P1 of print head support 30 can be accurately positioned relative to the platen roller 50.

Second Embodiment

A second embodiment of a printer having a print head pressure mechanism according to the present invention is described next. This embodiment differs from the first embodiment in that the compression springs 61*a* and 61*b* contact the back of print head support 30 at a different location.

More specifically, the contact positions of the compression springs 61*a* and 61*b* (i.e., working points F1 and F2) are shifted a small compensation distance (such as approximately 1 mm) along working line L4 toward the drive side from the positions determined as described in the first embodiment above.

This is to compensate for the shift that was found to occur during printing in actual printer products using the print head pressure mechanism of our invention. More specifically, printing tests showed that the working points F1 and F2 of compression springs 61*a* and 61*b* shift slightly to the other side when printing. Shifting the contact positions of the compression springs 61*a* and 61*b* as in this embodiment compensates for this.

Furthermore, this compensation distance can also be obtained by computer analysis using as parameters such external factors contributing to this offset in working points F1 and F2 as friction of the recording medium on the thermal print head 40 during printing, the thickness of print head support 30, temperature of the heat elements of thermal print head 40, and the rubber hardness of the platen roller 50. Computer analysis also showed it is only necessary to shift the working points F1 and F2 one millimeter toward the drive side.

By thus shifting the contact positions of the compression springs 61*a* and 61*b* a specific distance from the position of static balance obtained as described in the first embodiment, a print head pressure mechanism according to this second embodiment of the invention can achieve a so-called dynamic balance whereby the working point of the combined forces F1 and F2 acts on reference point P4 even if the respective working points F1 and F2 of the compression springs 61*a* and 61*b* shift during printing, for example.

It is therefore possible to achieve a printer 1 capable of maintaining uniform printing density under a variety of conditions by appropriately setting the parameters used to obtain this compensation value.

This is particularly beneficial when the spring support 62 is mounted removably to the spring mount 63 as described in the first embodiment with reference to FIG. 4 because spring supports having compression springs 61 designed to plural compensation values can be prepared for quickly adapting the print head pressure mechanism to various situations.

The exemplary embodiments described above can be varied in many ways without departing from the scope of the accompanying claims. For example, two compression springs each producing the same load are positioned equidistant to reference point P4 in the above embodiments, but it is also possible to use compression springs producing different loads. In this case it is only necessary to determine the distance from reference point P4 according to the load ratio of the springs. For example, if spring 61 applies a load f and spring 61*b* applies load 2*f, the distance d2 and d3 from reference point P4 for these respective loads is d2=2*d3.

Furthermore, while the above preferred embodiments of the invention are described using two compression springs 61, the invention shall not be so limited as it is also possible to use only one or three or more compression springs 61. If there is only one compression spring 61, the compression spring 61 is positioned so that the working point thereof is offset to the drive side from reference point P4 as shown in FIG. 7(*c*). This assures that even if a load change occurs along print line L3, the drive-side support shaft 31*a* of print head support 30 can be held firmly in contact with end edge 5*c* of positioning channel 5.

On the other hand, if three or more compression springs 61 are used, the compression springs 61 must be positioned so that the sum of the moments around P6 of the spring force is equal to the moment around P6 of the combined forces acting on reference point P4. In other words, the working point of the combined force must be positioned on the median.

While in the above embodiments both support shafts 31*a* and 31*b* are disposed to the print head support 30, and positioning channel 5 and guide channel 6 are disposed to the frame members 2*a* and 2*b*, the positioning channel and guide channel can alternatively be disposed to the print head support 30, and the support shafts to the frame members 2*a*, 2*b*.

The present invention provides a print head pressure mechanism that can assure uniform pressure between the thermal print head and platen roller without being affected by variations in parts precision, and that can therefore print with uniform print density. The present invention also provides a printer equipped with the print head pressure mechanism of our invention.

What is claimed is:

1. A print head pressure mechanism comprising:

a print head support having a print head disposed on a surface thereof, the print head having a plurality of heat elements arranged along a heat element line, the print head support including first and second support sections disposed respectively at first and second sides thereof;

a platen moveably disposed adjacent the print head support and facing the surface of the print head support where the print head with the heat elements are disposed, the platen defining a platen axis;

first and second frame members for respectively supporting the first and second support sections; and at least one urging unit for urging the print head support toward the platen;

wherein the first and second support sections are supported by the first and second frame members such that the platen axis and the heat elements line are non-parallel to each other when the platen is not in contact with the print head support, and are substantially parallel to each other when the platen is in contact with the print head support.

2. The print head pressure mechanism of claim 1, wherein the first and second frame members include respective first and second guide members for guiding the first and second support seconds in a direction substantially perpendicular to the platen axis.

3. The print head pressure mechanism of claim 2, wherein each of the first and second guide members has an end portion for respectively contacting and stopping further movement of the first and second support sections, and wherein when the first and second support sections contact the respective end portions, a line defined by the first and second support sections is non-parallel to the platen axis.

4. The print head pressure mechanism of claim 1, wherein the at least one urging unit exerts a combined force on the print head support at a working point, the working point being positioned near a line segment connecting a point of contact of the first support section and the first frame member, and the midpoint of a contact line between the print head support and the platen.

5. The print head pressure mechanism of claim 4, wherein the working point is positioned on the line segment.

6. The print head pressure mechanism of claim 4, wherein the working point is offset from the line segment toward the first frame member.

7. The print head pressure mechanism of claim 4, wherein the working point is positioned closer to the midpoint of the contact line than to the point of contact of the first support section.

8. A thermal line printer comprising a print head pressure mechanism of claim 1.

9. The thermal line printer of claim 8, further comprising a drive mechanism for driving the platen, the drive mechanism being disposed closer to the first frame member.

10. The thermal line printer of claim 8, further comprising a printer body and a cover pivotally attached to the body, wherein the platen is attached to the cover and is moveable between a first position when the cover is open and a second position when the cover is closed, wherein the platen is in contact with the heat elements of the print head on the print head support in the first position and is no in contact with the heat elements in the second position.

11. A print head pressure mechanism comprising:

a print head support having a print head with a plurality of heat elements, the print head support including first and second support sections disposed respectively at first and second sides thereof;

a platen moveably disposed adjacent the print head support, the platen defining a platen axis; and first and second frame members for respectively supporting the first and second support sections, the first and second frame members including respective first and second guide members for guiding the first and second support sections in a direction substantially perpendicular to the platen axis, each of the first and second guide members having an end portion for contacting and stopping further movement of the respective support sections, and wherein when viewed from a direction parallel to the platen axis, the end portions of the first and second guide members do not overlap with each other.

12. The print head pressure mechanism of claim 11, further comprising at least one urging unit exerting a combined force on the print head support at a working point to urge the print head support toward the platen, the working point being positioned near a line segment connecting a point of contact of the first support section and the first frame member, and the midpoint of a contact line between the print head support and the platen.

13. The print head pressure mechanism of claim 12, wherein the working point is positioned on the line segment.

14. The print head pressure mechanism of claim 12, wherein the working point is offset from the line segment toward the first frame member.

15. The print head pressure mechanism of claim 12, wherein the working point is positioned closer to the midpoint of the contact line than to the point of contact of the first support section.

16. A print head pressure mechanism comprising:

a frame having third and fourth supports provided on a first and a second frame side, respectively;

a print head support having first and second opposite sides with a print head on said first side, and having first and second support on opposite third and fourth sides, respectively, the print head having a plurality of heating elements arranged on a first line, said first and second supports defining a pivot axis parallel to said first line and cooperating with the third and fourth supports, respectively, to pivotally support the print head support in the frame;

a platen supported in said frame so as to be movable relative to the frame between a first and a second position, the first and second positions of the platen being substantially parallel to each other; and urging unit for urging the print head support toward the platen around said pivot axis, the urging unit exerting pressure onto said second side of the print head support, wherein in its first position, the platen faces said heating elements and applies a reaction force onto said first side of the print head support, a platen axis of the platen being parallel to said first line and defining together with said first line a reference plane, and in its second position, the platen is separated from the print head support and the projection of said platen axis onto said reference plane intersects said first line, and wherein one of said first and third support comprises a first shaft portion and the other of said first and third support comprises a first opening for receiving the first shaft portion, and one of said second and fourth support comprises a second shaft portion and the other of said second and fourth support comprises a second opening for receiving the second shaft portion, said second opening having an end edge, at least said second shaft portion being linearly moveable in said second opening such that said pivot axis is movable in a plane substantially parallel to said reference plane, said second shaft portion being urged in response to said pressure into contact with said end edge of said second opening in said second position of said platen, and being separated from said end edge in said first position of said platen as a result of said reaction force.

17. The print head pressure mechanism of claim 16, wherein each of said openings comprises a guide channel having two opposite guide edges substantially in parallel to said reference plane to guide said first and second shaft portions, respectively, therebetween, and said first opening having an end edge substantially perpendicular to said guide edges, said first shaft portion being kept in contact with the end edge of said first opening in said first and second positions of said platen.

18. The print head pressure mechanism of claim 17, wherein the urging unit comprises one or more flexible bodies, and a working point of a combined force of said one or more flexible bodies on said print head support is positioned on or near a second line connecting a contact point between said first shaft portion and said end edge of said first opening and the midpoint of a line of contact between the platen and the print head support in said first position of the platen.

19. The print head pressure mechanism of claim 18, wherein the working point is offset from said second line, in a direction substantially parallel to said first line, toward the side of said contact point.

20. The print head pressure mechanism of claim 18, wherein the working point is positioned closer to said first line than to said contact point.

* * * * *